US005709564A

United States Patent [19]

Yamada et al.

[11] Patent Number: 5,709,564

[45] Date of Patent: Jan. 20, 1998

[54] WIRING CIRCUIT FOR AN ELECTRICAL CONNECTION BOX, METHOD AND APPARATUS FOR FORMING THE WIRING CIRCUIT

[75] Inventors: Takayuki Yamada; Hiroshi Rokutani; Nori Inoue; Yuuji Saka; Takahiro Onizuka; Yoshito Oka, all of Yokkaichi, Japan

[73] Assignee: Sumitomo Wiring Systems, Ltd., Japan

[21] Appl. No.: 515,116

[22] Filed: Aug. 14, 1995

[30] Foreign Application Priority Data

Aug. 24, 1994 [JP] Japan ..... 6-199486
Dec. 13, 1994 [JP] Japan ..... 6-309280

[51] Int. Cl.[6] ..... H01R 4/24

[52] U.S. Cl. ..... 439/392; 29/866; 439/404

[58] Field of Search ..... 439/392–395, 439/404, 417, 419; 29/866, 867

[56] References Cited

U.S. PATENT DOCUMENTS

| | | | |
|---|---|---|---|
| 3,909,935 | 10/1975 | Aldridge et al. | 29/866 |
| 4,049,334 | 9/1977 | Siden | 439/392 |
| 4,066,320 | 1/1978 | Goodrich et al. | 439/392 |
| 4,194,256 | 3/1980 | Knickerbocker . | |
| 4,258,973 | 3/1981 | Reynolds et al. | 439/392 |
| 4,684,765 | 8/1987 | Beck et al. . | |
| 4,911,655 | 3/1990 | Pinyan et al. | 29/866 |
| 5,156,557 | 10/1992 | Okafuji et al. . | |

FOREIGN PATENT DOCUMENTS

| | | |
|---|---|---|
| 0 044 636 | 7/1981 | European Pat. Off. . |
| 0 295 693 | 6/1988 | European Pat. Off. . |
| 1 916 769 | 11/1969 | Germany . |
| 5-227631 | of 1993 | Japan . |
| 2 264 885 | 9/1993 | United Kingdom . |
| 2 278 075 | 11/1994 | United Kingdom . |

*Primary Examiner*—J. J. Swann
*Attorney, Agent, or Firm*—Anthony J. Casella; Gerald E. Hespos; Ludomir A. Budzyn

[57] ABSTRACT

To provide a wiring circuit for an electrical connection box, a method and a device for cutting a wire for circuits is provided. The method and device are inexpensive and capable of securely cutting the wire and separating the circuits in one operation step. A wiring circuit for an electrical connection box comprises wire portions and connecting terminals connected with the wire portions. The wire portions are made by cutting a wire such that at least one of the two cut ends of the wire is bent with respect to the extension direction of the wire simultaneously with the cutting of the wire.

13 Claims, 8 Drawing Sheets

WIRING CIRCUIT FOR AN ELECTRICAL CONNECTION BOX, METHOD AND APPARATUS FOR FORMING THE WIRING CIRCUIT

BACKGROUND OF THE INVENTION

1. Field of the Invention

The present invention relates to a wiring circuit for an electrical connection box of an automotive vehicle, and to a method and a device for cutting a wire so as to form a wiring circuit. The present invention is particularly designed to easily and securely cut a wire to separate it into wire portions forming individual circuits of the wiring circuit.

2. Description of the Prior Art

The prior art includes electrical connection boxes for easily responding to a design change of a wiring circuit. The prior art electrical connection box includes box wires instead of a busbar formed by punching a conductive metal plate. Connections between a wire and external output terminals are established by the use of cramping terminals.

The applicant of the present invention already proposed a method for forming internal circuits constituted with a wire and cramping terminals as shown in FIG. 12. A wiring groove 115 is formed in an insulating plate 106 mounted in the electrical connection box. A wire W arranged with one stroke from a starting point to an end point in advance in a wiring mold is transferred to and arranged along the wiring groove 115 of the insulating plate 106. The thus arranged wire W is cramped with the cramping terminals and its unnecessary portions W' are cut off to separate the individual circuits.

As shown in FIG. 12, the unnecessary portions W' of the wire W arranged along the groove 115 formed in the insulating plate 106, which are indicated by hatched portions, are separated from the desired wire portions W by cutting the opposite ends P1 and P2 of each unnecessary wire portion W'. Accordingly, in order to separate one unnecessary wire portion W', a cutting step needs to be performed twice. Thus, as the number of the unnecessary wire portions W' increases, the cutting requires a longer time, thereby lowering the working efficiency. Further, a mechanism for removing the cut unnecessary wire portions W' is required, which leads to an increased production cost for the apparatus.

In view of the above, the following method was proposed (see Japanese Unexamined Patent Publication No. 5-227631). Specifically, as shown in FIG. 13, cramping terminals 103, 103 are so mounted as to project from a connector receptacle 102 mounted on the inner surface of an insulating support 101, and a wire W is pressed into the cramping terminals 103, 103. Then, as shown in FIG. 13(B), an unnecessary portion W' of the wire W is cut with a cutter (not shown), and the opposing cut ends W1 and W2 of the wire W are bent downward by a press 105 into a wire retaining slot 106 formed in the connector receptacle 102. In this way, the cut ends W1 and W2 are separated from each other.

However, the above method requires two steps: a step of cutting the wire W and a step of pressing the cut ends W1 and W2. This method also requires the formation of the wire retaining slot 106 in the connector receptacle 102, which leads to an increased production cost and restricts the wire cutting position to the position where the wire retaining slot 106 is formed.

The present invention was developed to solve the above problems and an object thereof is to provide a wiring circuit and a method and an apparatus for forming a wiring circuit for an electrical connection box safely and inexpensively.

SUMMARY OF THE INVENTION

The inventive wiring circuit has only one wire cutting position for each circuit. The wire is cut, and at least one end formed by the cut is bent. No bent cut end returns to its original linear shape because of the rigidity of the wire. Thus, the individual circuits can securely be separated.

The inventive wiring circuit may be easily and effectively produced, particularly by the inventive method for forming such a wiring circuit. Preferably, an inventive device for cutting a wire is used for performing the inventive method.

According to a first preferred embodiment, the two cut ends are bent in opposite directions. This preferred embodiment provides a maximum safety with regard to short-circuit as the two cut ends have the largest possible distance. On the other hand, this wiring circuit is easily producible by a suitable cutting device, in which two cutting portions are moved with respect to each other and with respect to the wire to be cut.

According to an alternative preferred embodiment, one of the two cut ends is not bent with respect to the extension direction of the wire. This preferred embodiment is particularly useful, if the distance between connecting terminals to be connected with the two cut ends needs to be small. Although this embodiment is not as advantageous as the first alternative with regard to safety against short-circuit, this preferred wiring circuit is most efficient with respect to the space needed.

An improved degree of freedom in terms of a wire cutting position is achieved if the cut ends are bent within the plane of the wiring pattern. Namely, it is not necessary to provide any recesses for the bent cut ends in an insulating plate, provided that the wiring circuit is provided on the insulating plate. Further, this preferred wiring circuit is easy to manufacture, e.g. by the inventive cutting device. It is not necessary to perform two steps for cutting and separating the cut ends, respectively.

Preferably, the pitch of the connecting (preferably cramping) terminals connected with the wire at the opposite sides of the cutting portion, i.e., a spacing between insertion holes for the connecting terminals is set equal to the pitch of terminal holes of the connection box, e.g. of a connector receptacle into which the input/output terminal portions of the cramping terminals are inserted. This enables the use of normal cramping terminals formed by pressing a flat plate as those to be pressed into the insertion holes, thereby obviating the need to use specially bent cramping terminals.

Preferably, a separator which may project from a casing or an insulating plate of the electrical connection box is inserted between the cut ends of the wire.

More specifically, in the case where the wire is arranged along a groove formed in the insulating plate, a separator projecting from the inner surface of the casing can easily be inserted between the cut ends of the wire. On the other hand, in the case where the wire is arranged on the inner surface of the casing, a separator projecting from the insulating plate can be inserted between the cut ends of the wire.

In a preferred embodiment, a portion of the insulating plate with which the bent part of the wire comes into contact is bevelled. Thus, the cut end of the wire can more easily be bent and can be separated from the other cut end by a greater distance.

According to the inventive method, the unnecessary portion of the wire arranged in the casing is cut in one position and, simultaneously, at least one of the cut ends is bent with respect to the extension directions simultaneously with the cutting. Thus, the cutting and the bending can securely be performed in one operation step.

Further, unlike the prior art method, this method does not require a wire retaining slot into which the cut ends are pressed. Accordingly, the wiring circuit can be formed at a reduced cost and with an improved degree of freedom in terms of the wire cutting position.

According to the inventive device, the wire is cut from the opposite lateral sides by the cutting edges and, simultaneously, at least one cut end of the wire is bent with respect to the extension direction of the wire by the bending portion continuous with the corresponding cutting edge. Thus, this apparatus is capable of simultaneously cutting and bending the wire during the cutting operation. In other words, cutting and bending are performed in one step. The bending portions are capable of bending the cut ends so that the ends are electrically disconnected. Preferably, the cut ends are bent by more than 45°, more preferably 90°.

Preferably, the device comprises a fixed cutter for immovably retaining the wire when the wire is cut, and a drive cutter which slides along the fixed cutter to cut the wire retained by the fixed cutter and simultaneously to bend one of cut ends of the wire.

With the preferred cutting device, the cutting portion of the wire arranged in the electrical connection box is inserted into a slit formed in the fixed cutter so that the wire can be retained. When the drive cutter slides along the fixed cutter in this state, it cuts the wire immovably retained in the slit and simultaneously bends the cut end of the wire at the side of the drive cutter in the sliding direction. In other words, the wire is cut and the one cut end is bent simultaneously during one cutting operation.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Hereafter, a first embodiment of the invention is described in detail with reference to FIGS. 1 to 5.

Figure 13A:
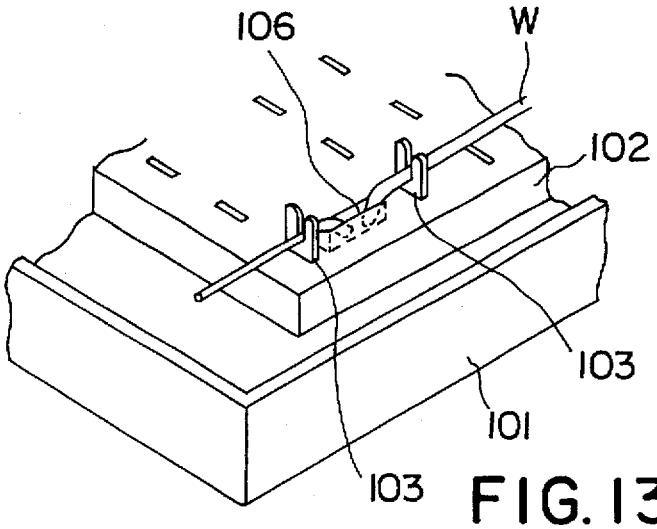
FIG. 13A PRIOR ART
FIGS. 13(A), 13(B) and 13(C) show a cutting construction for another prior art method, FIG. 13(A) being a perspective view, FIGS. 13(B) and 13(C) being side views before and after the cut ends are pressed, respectively.
Figure 13B:
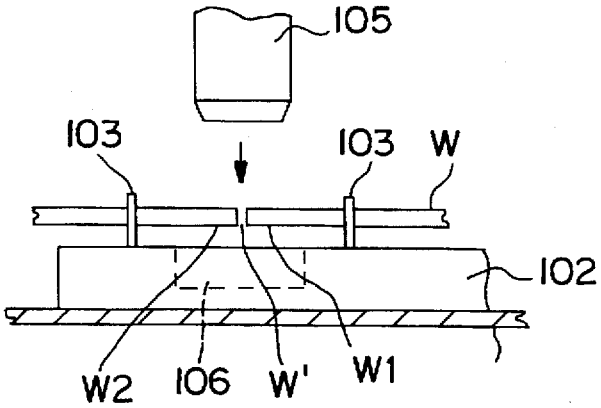
FIG. 13B PRIOR ART
Figure 13C:
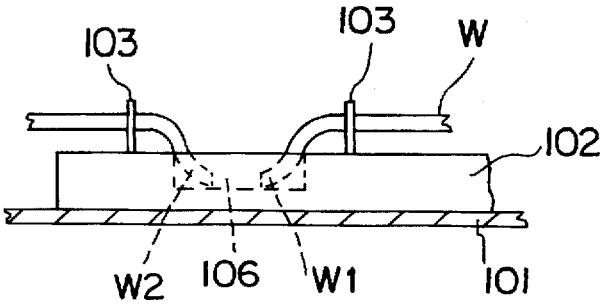
FIG. 13C PRIOR ART

It will be appreciated that elements having the same construction and action as those shown in FIGS. 13(A) to 13(C) are identified by like reference numerals and that no detailed description is given thereto.

Figure 2A:
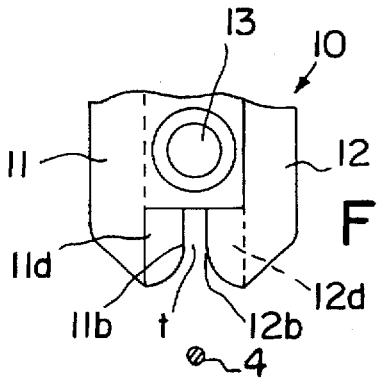
FIGS. 2(A) and 2(B) are front and bottom views of the cutting device of FIGS. 1(A) and 1(B) during a waiting period.
Figure 2B:
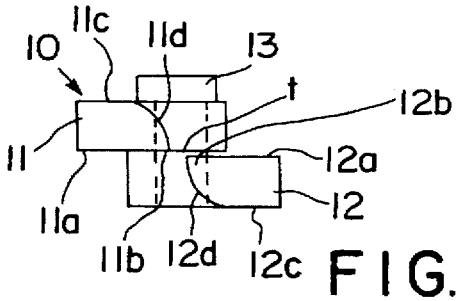

As shown in FIGS. 2(A) and 2(B), a cutting device 10 for cutting a wire 4 is a cutting tool similar to scissors. Two thick metal blades 11 and 12 are openably and closably mounted on a pin 13 so that inner surfaces 11*a* and 12*a* thereof are crossingly moved against each other.

Figure 3:
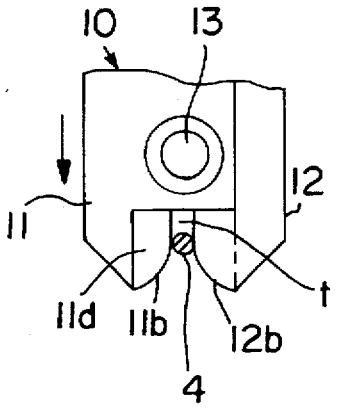
FIG. 3 is a front view of the cutting device of FIGS. 1(A) and 1(B) when it is moved downward.

As shown in FIG. 3, the opposing inner edges of the blades 11 and 12 defining a clearance t are moved downward so as to locate the wire 4 therein, and are formed with arcuate cutting edges 11*b* and 12*b*, respectively, for cutting the wire 4 from the opposite lateral sides when the blades 11 and 12 are closably rotated about the pin 13.

Figure 1A:
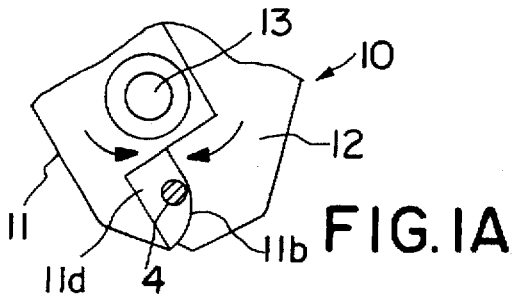
FIGS. 1(A) and 1(B) are front and bottom views of a first embodiment of a cutting device according to the invention during a cutting/bending operation, respectively.
Figure 1B:
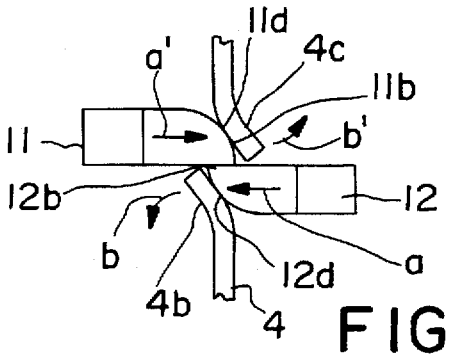

Unlike pinching and nipping devices, the cutting edges 11*b* and 12*b* cross each other as shown in FIG. 1(B).

As shown in FIGS. 2(A) and 2(B), bending portions 11*d* and 12*d* having a quadrantal cross-section and being formed continuous with the cutting edges 11*b* and 12*b* are formed on outer surfaces 11*c* and 12*c* of the blades 11 and 12, respectively.

Figure 4A:
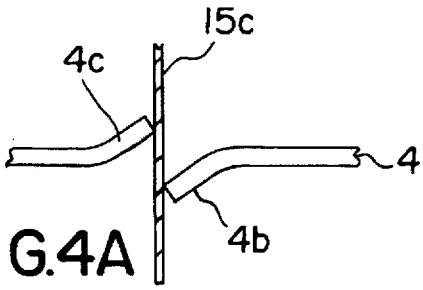
FIG. 4(A) is a section along line A—A of FIG. 4(B)
Figure 4B:
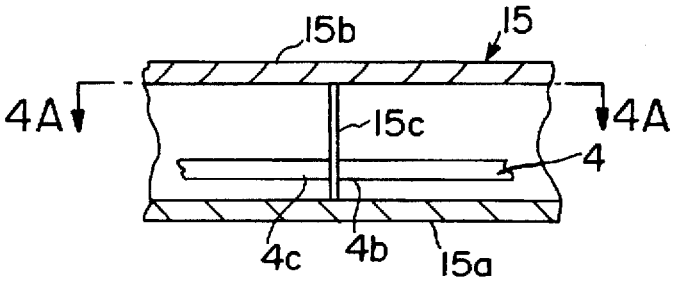
FIG. 4(B) is a side view in section of the electrical connection box.

The cutting device 10 constructed as above is moved downward as shown in FIG. 3 after being moved to a position above any part of an unnecessary portion of the wire 4 arranged within an electrical connection box 15 (see FIG. 4(B)), with the result that this part of the wire 4 is located in the clearance t defined by the blades 11 and 12.

Thereafter, when the blades 11 and 12 are closably rotated about the pin 13 as shown in FIGS. 1(A) and I(B), the wire 4 is cut by the cutting edges 11*b* and 12*b* from the opposite lateral sides.

Simultaneously with this cutting, cut ends 4*b* and 4*c* of the wire 4 are bent in opposite directions b and b' by the bending portions 11*d* and 12*d* of the blades 11 and 12 moving in directions of arrows a and a', respectively thereby being separated from each other (FIGS. 1(A) and 1(B)).

Because of its rigidity, the wire 4 does not return to its original linear shape after being bent in the opposite directions as above.

In this way, the unnecessary portion of the wire 4 is cut in one position and the cut ends 4*b* and 4*c* are bent in the opposite directions b and b' and separated from each other. Thus, the short-circuiting of the cut ends 4*b* and 4*c* can be securely prevented and the cutting and the bending can effectively be performed in one operation step.

Further, since a wire retaining slot into which the cut ends 4b and 4c are pressed is unnecessary, the production cost is lower and the wire 4 can be cut with an improved degree of freedom in terms of the wire cutting position.

As shown in FIGS. 4(A) and 4(B), if an upper casing 15b of the electrical connection box 15 is formed with a separator 15c which is inserted between the cut ends 4b and 4c when a lower casing 15a of the electrical connection box 15 is covered from above with the upper casing 15b as shown in FIGS. 4(A) and 4(B), the short-circuiting of the cut ends 4b and 4c can even more securely be prevented.

Figure 5:
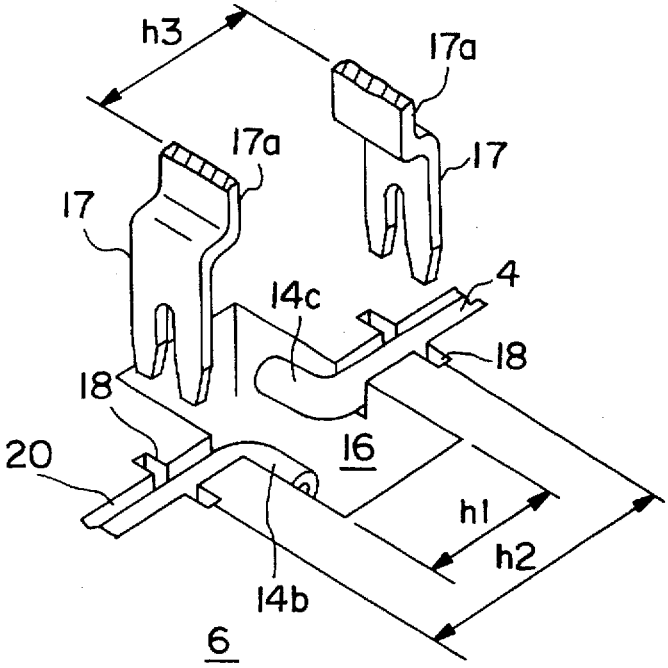
FIG. 5 is a perspective view of an example of a wiring circuit formed using the cutting device of FIGS. 1 to 3.

An example of a wiring circuit according to the first embodiment is shown in FIG. 5.

In the case where the cut ends are bent in opposite directions, the wire 4 arranged along a groove 20 formed in the insulating plate 6 of the electrical connection box needs to be cut by the cutting device 10. Accordingly, a cutting device insertion slot 16 needs to be formed in a position corresponding to a cutting portion of the wire 4 as shown in FIG. 5. A width h1 of the slot 16 in the wire arranging direction needs to be large enough for the cutting device 10 to be inserted therein and to perform the cutting. Since the cut ends of the wire 14 are bent in opposite directions after the cutting, the width h1 also needs to be about twice as long as a distance between a point of bending and an end of the cut end (e.g., about 5 mm).

Figure 9:
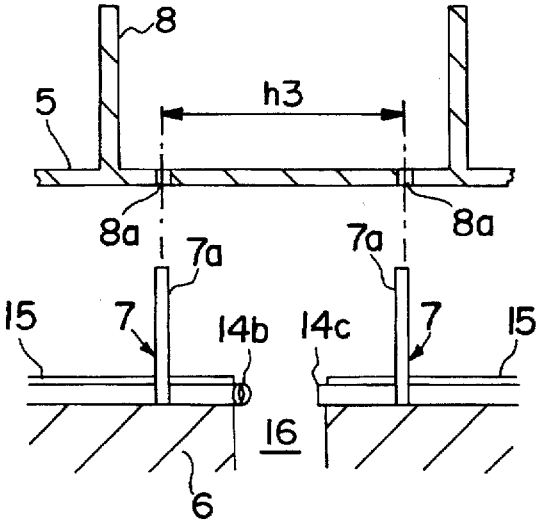
FIG. 9 is a side view in section showing the relationship between a pitch of cramping terminals pressed into the wiring circuit of FIG. 8 and a pitch of terminal holes formed in a connector receptacle.

However, if the width h1 of the cutting device insertion slot 16 is set at about 5 mm, a pitch h2 of slots 18, 18 into which cramping terminals 17, 17 mounted at opposite sides of the slot 16 in the wire arranging direction are pressed is inevitably widened. Accordingly, the pitch h2 can become larger than a pitch h3 of terminal holes of a connector receptacle formed in the electrical connection box. Thus, normal flat cramping terminals cannot be used, when the input/output terminal portions of the cramping terminals 17, 17 at the opposite sides of the cutting portion are inserted into the adjacent terminal holes of the connector receptacle. In order to set the pitch of the input/output terminal portions 17a, 17a equal to the pitch h3 of the terminal holes, specially bent cramping terminals 17, 17 as shown in FIG. 9 need to be used. This disadvantageously leads to an increased production cost.

Hereafter, a second embodiment of the invention, overcoming the above problem, is described with reference to FIGS. 6 to 11.

Figure 12:
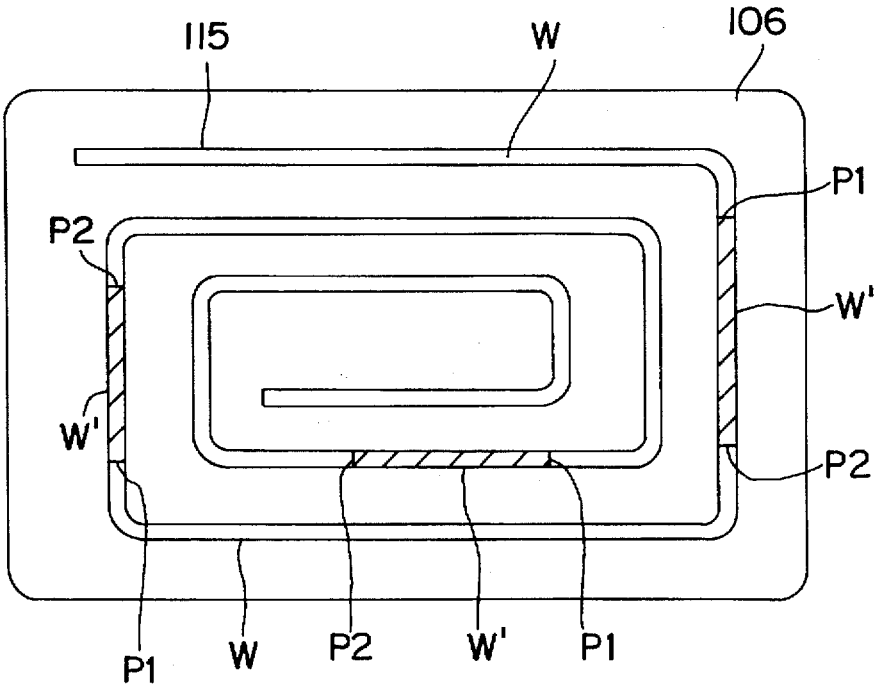
FIG. 12 PRIOR ART
FIG. 12 is a schematic diagram showing how a continuous strand of wire arranged in a prior art wiring circuit is cut to separate each circuit.

Internal circuits of an electrical connection box according to the invention are formed similar to the prior art internal circuits shown in FIG. 12. Specifically, a continuous strand of wire arranged in a wiring mold is transferred to a wiring groove 115 formed in an insulating plate 106 mounted in the electrical connection box, and cramping terminals are applied at specified positions to cramp the wire W.

Figure 6A:
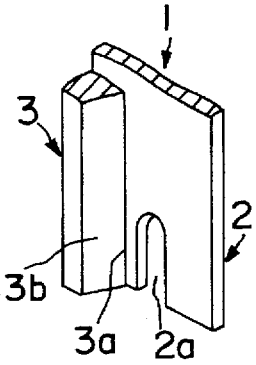
FIG. 6(A) is a perspective view of a second embodiment of a cutting device according to the invention.
Figure 6B:
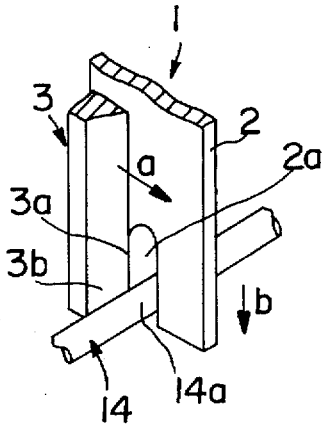
FIGS. 6(B) and 6(C) are perspective views showing the cutting device during a wire cutting/bending operation.
Figure 6C:
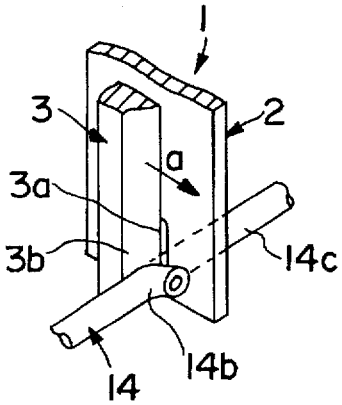
Figure 7A:
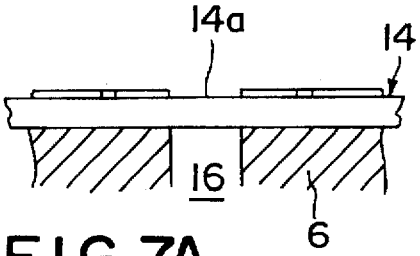
FIG. 7(A) is a side view in section of a cutting portion of the wire arranged along a wiring groove.
Figure 7B:
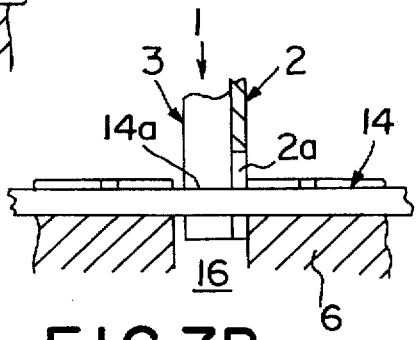
FIG. 7(B) is a side view in section showing a state where the cutting device of FIGS. 6(A) to 6(C) is inserted to cut the cutting portion of the wire.

FIGS. 6(A) to 6(C) show the leading end of a cutting device 1 used to form a wiring circuit according to the second embodiment of the invention, and FIGS. 7(A) and 7(B) show the cutting device 1 inserted into a cutting device insertion slot 16 formed so as to correspond to a portion 14a of a wire 14 to be cut.

The cutting device 1 is a cutting tool similar to scissors as shown in FIG. 6(A), and includes a fixed cutter 2 and a drive cutter 3. The drive cutter 3 is slidably mounted along the side surface of the fixed cutter 2.

The fixed cutter 2 is of a thin metal plate and is formed at its leading end with a U-shaped slit 2a opening downward. On the other hand, the drive cutter 3 is of metal material which is thicker than the fixed cutter 2 and has a trapezoidal cross-section, and is formed at its edge which faces the slit 2a with a cutting edge 3a for contacting the fixed cutter 2 and a bending portion 3b which is continuous with the cutting edge 3a and is slanted at a specified angle.

When the wire 14 arranged on the insulating plate 6 is to be cut by the thus constructed cutting device 1, the cutting device 1 is inserted into the insertion slot 16 from above so that the portion 14a of the wire 14 is located in the slit 2a of the fixed cutter 2 as shown in FIGS. 7(A) and 7(B).

When the drive cutter 3 is driven to slide in an arrow direction a while the cutting device 1 is held in the above state as shown in FIG. 6(B), the wire 14 retained by the slit 2a so as not to move in the arrow direction a is cut by the cutting edge 3a of the drive cutter 3.

Simultaneously, a cut end 14b of the wire 14 at the side of the drive cutter 3 is bent by the bending portion 3b of the drive cutter 3 moving in the arrow direction a even after the cutting.

Because of its rigidity, the wire 14 does not return to its original linear shape after it is bent.

As described above, the cutting device 1 is capable of cutting a portion of the wire 14 to be cut in one position 14a and separating the cut end 14b from the other cut end 14c by bending the cut end 14b. Thus, the short-circuiting of the cut ends 14b and 14c can be prevented and the cutting and the bending can securely be performed in one operation step.

The wiring circuit for the electrical connection box formed using the cutting device 1 is described with reference to FIGS. 8 to 10.

In the wiring circuit formed using the cutting device 1, the cut ends 14b and 14c of the wire 14 cut in the position corresponding to the insertion slot 16 extend into the insertion slot 16 from the wiring groove 15, but only the cut end 14b is bent. The other cut end 14c projects from the wall surface of the insertion slot 16 by a small distance which may correspond to the thickness of the fixed cutter 2.

Figure 8:
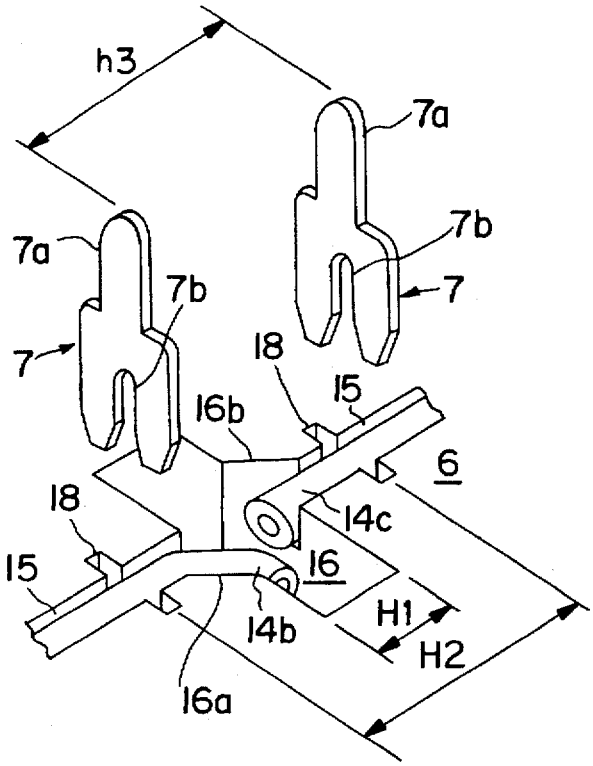
FIG. 8 is a perspective view of a wiring circuit according to another embodiment of the invention.

Thus, compared to the width h1 of the insertion slot 16 formed when both cut ends 14b and 14c of the wire 14 facing each other in the insertion slot 16 are bent and separated in opposite directions (see FIG. 5), a width H1 of the insertion slot 16 can be reduced to about one half (e.g., about 2.5 mm) according to this embodiment (FIG. 8).

Accordingly, a pitch H2 of cramping terminal insertion holes 18, 18 formed at the opposite sides of the insertion slot 16 can be made equal to a pitch h3 of terminal holes 8a, 8a of a connector receptacle formed in the electrical connection box 5. Cramping terminals 7, 7 are inserted into the terminal holes 8a, 8a so that their input/output terminal portions 7a, 7a project into the connector receptacle 8 (FIG. 9).

Thus, if normal cramping terminals 7 formed simply by punching a flat plate and having input/output terminal portions 7a extending linearly from their blades 7b are used for this wiring circuit, the pitch of the input/output terminals 7a, 7a can be equal to the pitch h3 of the terminal holes 8a, 8a. Therefore, the problem of high production costs resulting from the use of the specially bent cramping terminals 17, 17 as shown in FIG. 5 can be avoided.

Figure 10:
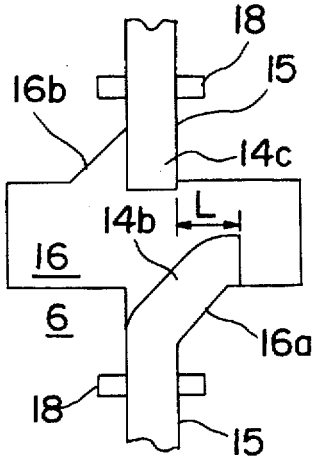
FIG. 10 is a plan view of the wiring circuit of FIG. 8.

In the above wiring circuit, a distance L by which the bent cut end 14b is separated from the other cut end 14c as shown in FIG. 10 is preferably 1.5 mm or longer in order to securely prevent the short-circuiting of the cut ends 14b and 14c.

Further, a corner portion 16a with which the bent part of the cut end 14b comes into contact when the cut end 14b is bent and where the wall surfaces of the wiring groove 15 and the insertion slot 16 intersect (transition portion between the groove 15 and the slot 16) may advantageously be bevelled so as to have a flat surface which is substantially at an angle of 45° to these wall surfaces as shown in FIG. 10. Then, the cut end 14*b* can more easily be bent and the distance L by which the cut end 14*b* is separated from the cut end 14*c* can be longer, with the result that the short-circuiting can more securely prevented.

In this case, if a corner portion 16*b* diagonally facing the corner portion 16*a* is similarly bevelled, the cut end 14*c* of the wire 14 can alternatively be bent by reversing the direction along which the cutting device 1 shown in FIG. 6 is inserted into the insertion slot 16. This eliminates the restriction on the inserting direction of the cutting device 1 into the insertion slot 16, resulting in a more rapid wire cutting operation.

Although the bevelled portion has a flat surface in this embodiment, it may have another shape (e.g., a curved surface).

Figure 11A:
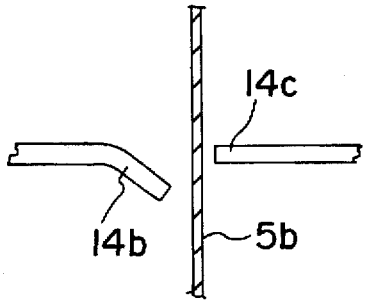
FIG. 11(A) is a section along line A—A of FIG. 11(B)
Figure 11B:
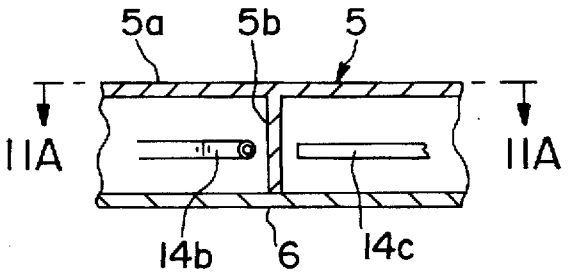
FIG. 11(B) is a side view in section of an electrical connection box.

An upper casing 5*a* may be formed with a separator 5*b* which is insertable between the cut ends 14*b* and 14*c* when it is mounted on the insulating plate 6 of the electrical connection box 5 from above as shown in FIGS. 11(A) and 11(B). Then, since the cut ends 14*b* and 14*c* can perfectly be separated from each other, the short-circuiting can even more securely be prevented.

As is clear from the above description, the cutting device according to this embodiment comprises the fixed cutter for retaining the cutting portion of the wire and the drive cutter for cutting the wire and simultaneously bending one cut end to separate from the other cut end. Since the wire can be cut and the circuits can be separated during one cutting operation, the wiring circuit for the electrical connection box can be formed efficiently and securely.

Since one cut end is bent to be distant from the other cut end by the predetermined distance or longer, and the wire does not return to its original linear shape because of its rigidity, each individual circuit can securely be separated. Particularly, since not both cut ends, but only one cut end is bent, a spacing between the insertion holes for the cramping terminals cramped with the wire at the opposite sides of the cutting portion can be made shorter.

If the separator is inserted between the cut ends of the wire in the wiring circuit, the short-circuiting of the cut ends can more securely be prevented.

In the wiring circuit according to this embodiment, the pitch of the cramping terminals cramped at the opposite sides of the cutting portion, with the wire arranged on the insulating plate mounted in the electrical connection box, i.e., the spacing between the insertion holes for the cramping terminals coincides with the pitch of the terminals holes of the connector receptacle formed in the electrical connection box. This enables the use of such normal cramping terminals that are formed by pressing a flat plate with their input/output terminal portions linearly extending from their blades, thereby obviating the need to use specially bent cramping terminals. Thus, the problem of high production costs can be avoided.

In addition, the portion of the insulating plate with which the bent part of the one cut end of the wire comes into contact is bevelled. Accordingly, the cut end of the wire can more easily be bent and can be separated from the other cut end by a greater distance. Thus, the short-circuiting of the cut ends can securely be prevented.

What is claimed is:

1. A wiring circuit for an electrical connection box (15;5), comprising: an insulating plate (6), first and second wire portions (4) disposed in a wiring pattern on said insulating plate (6) and having respective first and second end portions, first and second connecting terminals being mounted to said insulating plate (6) and being connected with the respective first and second wire portions (4), the wire portions (4) being made by cutting a wire arranged in the wiring pattern in at least one position, such that at least the first end portion (14*b*) formed by the cut is bent with respect to the extension direction of the wire in one step about an axis substantially orthogonal to the insulating plate such that said first end portion is substantially parallel to said insulating plate (6).

2. A wiring circuit for an electrical connection box (15;5), comprising wire portions and connecting terminals connected with the wire portions, wherein the wire portions are made by cutting a wire (4;14) which is arranged in a wiring pattern, and wherein the wire (4;14) is cut in at least one position to form two cut ends (4*b*,4*c*;14*b*,14*c*) and at least one (4*b*;14*b*) of the two cut ends (4*b*,4*c*;14*b*,14*c*) formed by each cut is bent with respect to an extension direction of the wire (4;14) in one step, and wherein the other (4*c*) of the two cut ends (4*b*,4*c*) is bent in the opposite direction.

3. A wiring circuit according to claim 1, wherein the other (14*c*) of the two cut ends (14*b*,14*c*) is not bent with respect to the extension direction of the wire (14).

4. A wiring circuit according to claim 1, wherein a pitch (h3) of the connecting terminals (7) connected with wire portions on opposite sides of the cutting position coincides with a pitch (H2) of terminal holes (18) formed in the electrical connection box.

5. A wiring circuit according to claim 1, wherein an insulating separator (15*c*;5*b*) is inserted between the cut ends (4*b*,4*c*;14*b*,14*c*) of the wire.

6. A wiring circuit for an electrical connection box (15;5), comprising wire portions and connecting terminals connected with the wire portions, wherein the wire portions are made by cutting a wire (4;14) which is arranged in a wiring pattern, and wherein the wire (4;14) is cut in at least one position to form two cut ends (4*b*,4*c*;14*b*,14*c*) and at least one (4*b*;14*b*) of the two cut ends (4*b*,4*c*;14*b*,14*c*) formed by each cut is bent with respect to an extension direction of the wire (4;14) in one step, the wire (4;14) is arranged in the wiring pattern along a wiring groove (20;115) formed in an insulating plate (6) mounted in the electrical connection box (15;5), the insulating plate (6), at each wire cutting position, being provided with a recess (16) for each bent portion (4*b*,4*c*;14*b*), at the respective wire cutting position, each said recess (16) being continuous with the wiring groove (20;115), the insulating plate (6) being bevelled at transition portions (16*a*,16*b*) between the wiring groove (115) and the recesses (16), and wherein at least one cut end of the wire portions is bent about the bevelled transition portions (16*a*, 16*b*).

7. A wiring circuit according to claim 2, wherein the wire is arranged on a wiring surface and wherein the cut ends are bent within the plane of the wiring pattern.

8. A method for forming a wiring circuit, comprising the steps of: arranging a wire (4;14) according to a substantially planar wiring pattern, cutting the wire (4;14) into first and second wire portions defining respectively first and second cut ends (4*b*,4*c*;14*b*,14*c*) of the wire (4;14) bending at least one of the cut ends (4*b*,4*c*;14*b*,14*c*) with respect to the extension direction of the wire in one step with the cutting, such that the bent cut ends lies substantially in the plane of the wiring pattern.

9. The method of claim 8, wherein the cutting is carried out by slidably moving a movable cutting blade over a stationary cutting blade for shearing the wire.

10. The method of claim 9, wherein the movable cutting blade moves in a direction parallel to the plane of the wiring pattern.

11. The method of claim 9, further comprising the step of slidably moving a second movable cutting blade over an opposed surface of the stationary cutting blade.

12. The method of claim 11, wherein the second movable cutting blade is moved parallel to the first movable cutting blade but in an opposite direction.

13. The method of claim 8, further comprising, as a first step, placing said wire in slots formed in a planar insulating plate for forming the planar wiring pattern.

* * * * *